US007654516B2

(12) United States Patent
Terao et al.

(10) Patent No.: US 7,654,516 B2
(45) Date of Patent: Feb. 2, 2010

(54) PAPER SHEET RUNNING-OUT MECHANISM

(75) Inventors: Masanori Terao, Owariasahi (JP); Riichi Kato, Nagoya (JP); Minoru Kadowaki, Toyota (JP); Shinji Shibata, Nagoya (JP); Toshifumi Mitsuyama, Hitachinaka (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 11/946,970

(22) Filed: Nov. 29, 2007

(65) Prior Publication Data

US 2008/0136087 A1 Jun. 12, 2008

(30) Foreign Application Priority Data

Dec. 6, 2006 (JP) ..... 2006-329619

(51) Int. Cl.
*B65H 3/06* (2006.01)

(52) U.S. Cl. ..... 271/119; 271/3.08; 271/314

(58) Field of Classification Search ..... 271/119, 271/314, 3.01, 120, 3.08
See application file for complete search history.

(56) References Cited

U.S. PATENT DOCUMENTS

| | | | | |
|---|---|---|---|---|
| 3,506,258 | A * | 4/1970 | Lindquist | 271/119 |
| 3,572,691 | A * | 3/1971 | Heinricy | 271/23 |
| 6,186,490 | B1 * | 2/2001 | Sugiura et al. | 271/10.09 |
| 6,331,000 | B1 * | 12/2001 | Beskitt et al. | 271/3.01 |
| 6,798,899 | B2 * | 9/2004 | Mennie et al. | 382/135 |
| 6,889,972 | B2 * | 5/2005 | Chang | 271/23 |
| 2006/0103066 | A1 * | 5/2006 | Stoll et al. | 271/113 |

FOREIGN PATENT DOCUMENTS

| | | |
|---|---|---|
| JP | 34-000709 | 2/1959 |
| JP | 58-047733 | 3/1983 |

(Continued)

OTHER PUBLICATIONS

Japanese Office Action dated Jul. 3, 2009 for Application No. 2006-329619.

(Continued)

*Primary Examiner*—Patrick H Mackey
*Assistant Examiner*—Jeremy Severson
(74) *Attorney, Agent, or Firm*—Antonelli, Terry, Stout & Kraus, LLP.

(57) ABSTRACT

Feed rollers, stopper rollers situated on both outer sides with respect to the feed rollers, each of the stopper rollers having part of the periphery being a highly frictional portion compared with other peripheral portions, and a flexible, radial member in a position on an inner side with respect to the stopper rollers are disposed on a feed roller shaft; and the highly frictional portions of the stopper rollers are in positions at which phases of the highly frictional portions are the same as phases of highly frictional portions of the feed rollers in a rotational direction respectively. On a pick roller shaft, pick rollers, which have highly frictional portions for passing a paper sheet to a paper sheet running-out section, and have flexible, radial members in positions at a side opposite to the highly frictional portions, are disposed in the same or inside positions in an axial direction with respect to both the outside stopper rollers disposed on the feed roller shaft.

11 Claims, 7 Drawing Sheets

FOREIGN PATENT DOCUMENTS

| | | | | |
|---|---|---|---|---|
| JP | 60171941 | A | * | 9/1985 |
| JP | 63282032 | A | * | 11/1988 |
| JP | 01048732 | A | * | 2/1989 |
| JP | 01069427 | A | * | 3/1989 |
| JP | 01-104529 | | | 4/1989 |
| JP | 01110444 | A | * | 4/1989 |
| JP | 01192630 | A | * | 8/1989 |
| JP | 01226632 | A | * | 9/1989 |
| JP | 01242330 | A | * | 9/1989 |
| JP | 01294132 | A | * | 11/1989 |
| JP | 02106525 | A | * | 4/1990 |
| JP | 02132024 | A | * | 5/1990 |
| JP | 02198929 | A | * | 8/1990 |
| JP | 02261738 | A | * | 10/1990 |
| JP | 03162332 | A | * | 7/1991 |
| JP | 03259836 | A | * | 11/1991 |
| JP | 03259837 | A | * | 11/1991 |
| JP | 04055235 | A | * | 2/1992 |
| JP | 04075931 | A | * | 3/1992 |
| JP | 05105250 | A | * | 4/1993 |
| JP | 05301646 | A | * | 11/1993 |
| JP | 06-115728 | | | 4/1994 |
| JP | 06156765 | A | * | 6/1994 |
| JP | 09-267931 | | | 10/1997 |
| JP | 2000-255809 | | | 9/2000 |
| JP | 2002-019985 | | | 1/2002 |
| JP | 2002-347961 | | | 12/2002 |
| JP | 2006-124084 | | | 5/2006 |

OTHER PUBLICATIONS

Japanese Office Action dated Jul. 13, 2009 for Application No. 2009-138054.

* cited by examiner

PAPER SHEET RUNNING-OUT MECHANISM

BACKGROUND OF THE INVENTION

1. Field of the Invention

The present invention relates to a paper sheet running-out mechanism, and for example, relates to a mechanism for automatically running out accumulated bills for use in an automated teller machine (called ATM) used in financial institutions.

2. Description of Related Art

The ATM has a bill handling mechanism for receiving and paying bills from/to a user. The mechanism has a bill receipt/payment port for discharging a bill to be paid to a user or charging a bill to be received and running out received bills one by one; a bill discrimination section for discriminating a bill to be received or paid; a temporal storing section for temporarily storing a received bill; a reject box for storing a rejected bill that did not meet a predetermined standard in the bill discrimination section; a recycle box for storing and keeping a received bill, and running out the bill as a bill to be paid; and a bill carrying path being connected to the respective sections or storages to carry the bill.

Recently, this type of bill handling mechanism is used even in foreign ATMs, and required to handle foreign bills having various sizes, in addition, required to be set on an outer wall in accordance with operation of the ATM. In particular, when the ATM is set on the outer wall, as the bill receipt/payment port for delivering and receiving a bill to/from a user, a mechanism in a presenter method is desirably used to prevent invasion of rain, dust or the like from the outside, in which a bill is horizontally put in and out through a thin slot-like port.

However, in the paper sheet running-out mechanism being horizontally disposed, bills each having a different length in a running-out direction are sometimes randomly accumulated. For example, in the case that a bill accumulated in a top (hereinafter, called top bill) is smaller than a bill accumulated in a second top (called second accumulated bill), and accumulated in the back in the running-out direction, when a pick roller passes the top bill to a running-out section, an event may occur, that is, the top bill cannot be passed to the running-out section in one revolution of the pick roller and consequently cannot be separated by a feed roller. Moreover, the top bill and the second accumulated bill may be passed to the running-out section by passing force of the pick roller at the same time, and the second accumulated bill may plunge into the running-out section before the top bill, consequently the accumulated, two bills may be run out together.

As a technique for overcoming this type of difficulties, for example, JP-A-2002-347961 discloses a bill running-out mechanism, in which the mechanism has a flexible, radial member disposed in the back of a pick rollerhaft in a running-out direction separately from the pick rollerhaft, a stopper roller disposed on a feed rollerhaft, which has a circumferential face made of metal being sufficiently lowly frictional compared with a portion of a running-out rotation phase of a feed roller to prevent running-out of a bill in a phase other than the running-out rotation phase, and a gate roller disposed in a position opposed to the stopper roller, and only a top bill is pre-passed into a running-out section by a flexible, radial member so that a front edge of the bill butts against a circumferential face of the stopper roller, thereby right and left portions of the front edge of the bill are aligned, and then the top bill first plunges into the running-out section, consequently only the top bill is securely separated.

SUMMARY OF THE INVENTION

However, according to the bill running-out mechanism according to the related art, since a rotation shaft, on which the flexible, radial member is mounted in the back of the pick rollerhaft in the running-out direction, is disposed separately from the pick rollerhaft, the bill is pre-passed by the flexible, radial member so as to butt against the stopper roller that right and left portions of a front edge of a paper sheet are aligned, and then the bill is run out by a portion of a running-out rotation phase of the feed roller. As a result, before the pre-passed paper sheet is run out by the portion of the running-out rotation phase of the feed roller, it is continuously applied with force in the running-out direction by the flexible, radial member. When a paper sheet having a low rigidity or a paper sheet having a bend is pre-passed, the paper sheet may buckle between the flexible, radial member and the stopper roller, leading to abnormal running-out. To overcome the difficulty, when the flexible, radial member is disposed at a side near the stopper roll to the utmost, a difficulty is caused, that is, the pick roller or pick rollerhaft interferes with the flexible, radial member, leading to abrasion.

It is desirable to provide a paper sheet running-out mechanism that can run out paper sheets having a low rigidity or paper sheets having a bend one by one from a top paper sheet of accumulated paper sheets while aligning angled right and left portions of a front edge of a paper sheet without causing buckle of the paper sheet.

A paper sheet running-out mechanism according to an embodiment of the invention is, preferably, configured such that feed roller, stopper roller on both outer sides with respect to the feed roller, each of the stopper roller having part of the periphery being a highly frictional portion compared with other peripheral portions, and a flexible, radial member in a position on an inner side with respect to the stopper roller are disposed on a feed rollerhaft; and the highly frictional portions of the stopper roller are set in positions at which phases are the same as phases of frictional portions of the feed roller in a rotational direction respectively; and furthermore gate roller are disposed in positions opposed to the stopper roller to prevent running-out of a paper sheet other than a paper sheet to be contacted with the feed roller and thus run out. On a pick rollerhaft, pick roller are disposed, which have highly frictional portions for passing a paper sheet to a paper sheet running-out section, and flexible, radial members in positions at a side opposite to the highly frictional portions, and furthermore the pick roller are disposed in the same or inside positions in an axial direction perpendicular to a running-out direction with respect to both outside stopper roller disposed on the feed rollerhaft.

According to an embodiment of the invention, on the pick roller, the highly frictional portions for passing a paper sheet are disposed, and the flexible, radial members for pre-passing the paper sheet are disposed in positions at a side opposite to the highly frictional portions, thereby a distance in a paper sheet running-out direction between the highly frictional portions and the stopper roller can be reduced. Moreover, force applied to the paper sheet by the flexible, radial member disposed on the feed rollerhaft becomes force in a drawing direction into the paper sheet running-out section, rather than force to induce buckle of a paper sheet. Therefore, pre-passing force of the flexible, radial members disposed on the pick roller can be shared with pre-passing force of the flexible, radial member disposed on the feed rollerhaft and thus controlled to the minimum. Consequently, even when the flexible, radial members disposed on the pick roller pre-pass a paper sheet having a low rigidity or a paper sheet having a bend, the members may allow the paper sheet to butt against the stopper roller and gate roller opposed to the stopper roller without causing buckle of the paper sheet. Furthermore, the flexible, radial member disposed on the feed rollerhaft can then draw the paper sheet into a stopper rolleride, and run out the paper sheet with the angled right and left portions of the front edge of the paper sheet being aligned.

DESCRIPTION OF THE PREFERRED EMBODIMENT

Hereinafter, an embodiment of the invention will be described with reference to drawings.

Figure 1:
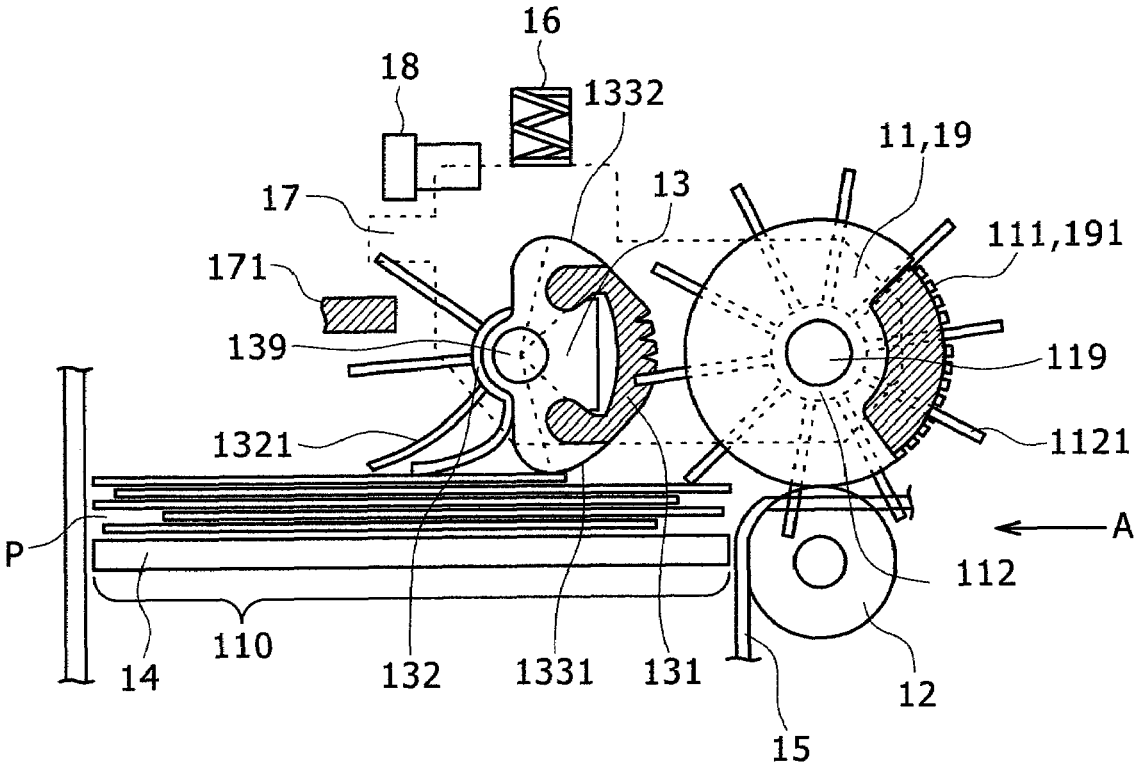
FIG. 1 is a side diagram showing a paper sheet running-out mechanism of an embodiment.
Figure 2:
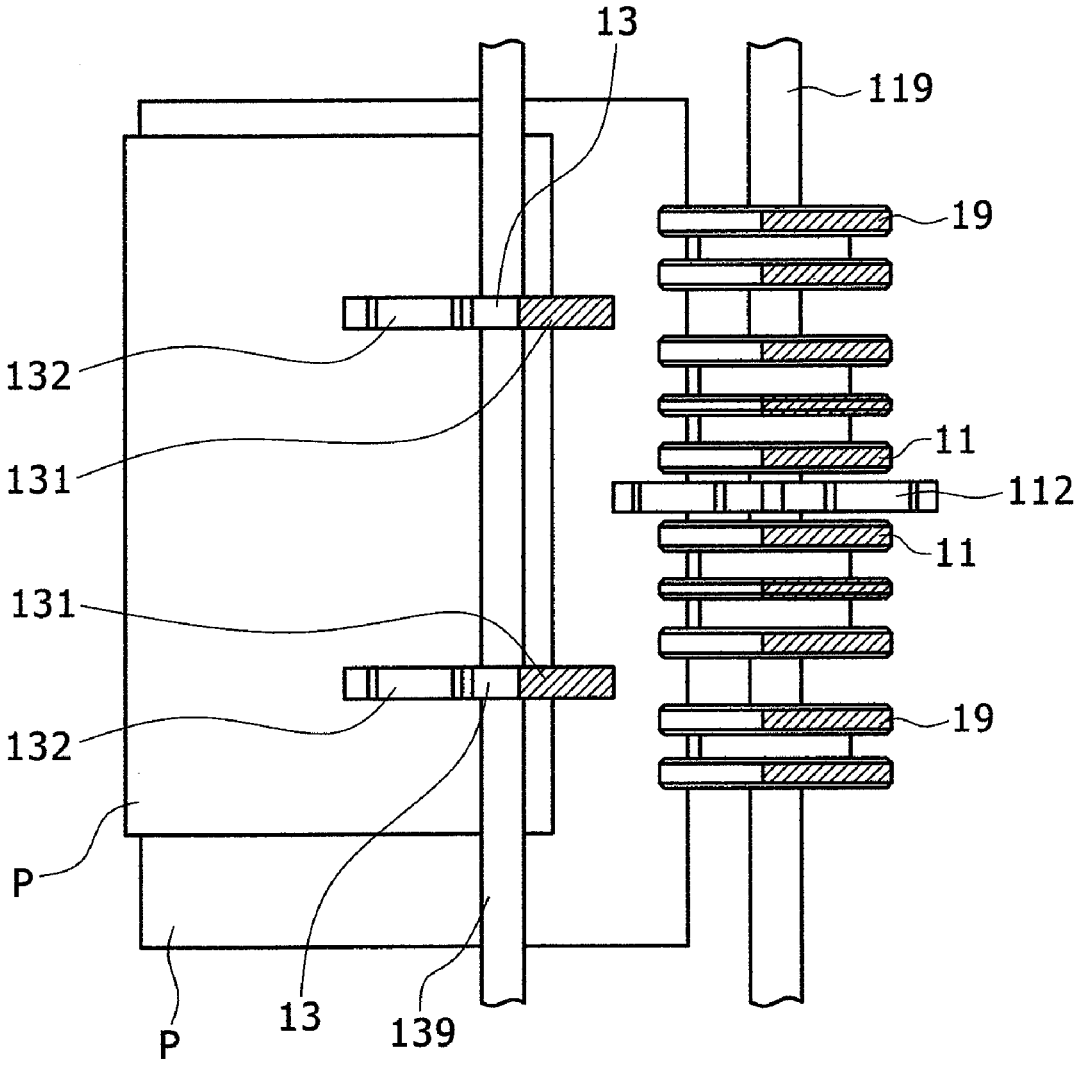
FIG. 2 is a front diagram showing the paper sheet running-out mechanism of the embodiment.
Figure 3:
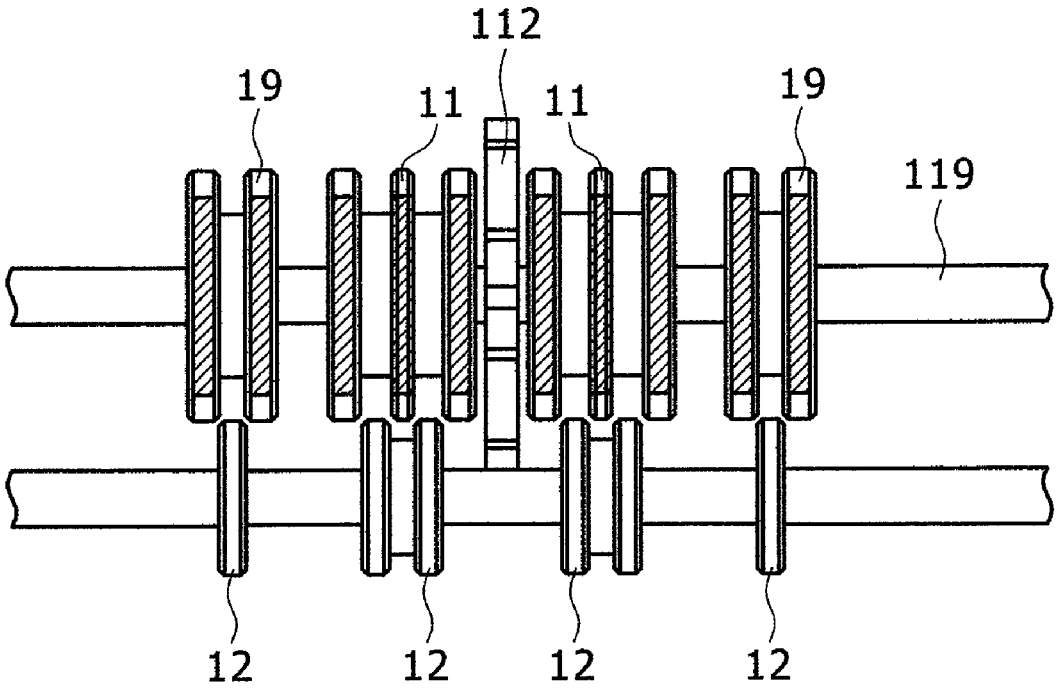
FIG. 3 is a diagram in the direction of an arrow seen from a direction A in FIG. 1.

A bill running-out mechanism of the embodiment is used for a bill handling mechanism of the ATM. Accumulated bills to be received (hereinafter, simply called accumulated bills), which was charged into a receipt/payment port unit by a user, are carried into an internal mechanism while being run out one by one by the bill running-out mechanism. FIG. 1 is a side diagram of the bill running-out mechanism according to the embodiment, FIG. 2 is a front diagram of the mechanism, and FIG. 3 is a diagram in the direction of an arrow from a direction in FIG. 1.

The bill running-out mechanism is configured to have feed roller 11 for running out accumulated bills P one by one from a top bill in terms of rotation; gate roller 12 being opposed to the feed roller 11 to prevent running-out of a bill other than a bill to be run out by the feed roller 11; pick roller 13 for passing a bill into a bill running-out section including the feed roller 11 and the gate roller 12; a press plate 14 for supporting the accumulated bills P and pressing the accumulated bills P to the pick roller 13; and a separation guide 15 for restricting movement of the accumulated bills P in a carrying direction.

The pick roller 13 are fixed to a pick rollerhaft 139, and furthermore supported by a movable component 17 that is pressed in a direction to the accumulated bills P at a constant force by a spring 16, the movable component being rotationally movable with a feed rollerhaft 119 as a center. The movable component 17 movably controls the press plate 14 in conjunction with a press detection sensor 18 such that the movable component 17 is driven according to a signal from the press detection sensor 18 to press the accumulated bills P to the pick roller 13 at a constant force.

Feed rubber portions 111 are disposed in part of the peripheries of the feed roller 11, and peripheral portions other than those are formed of a metal (for example, aluminum) or resin being sufficiently lowly frictional compared with the feed rubber portions 111. Pick rubber portions 131 are disposed in part of the peripheries of the pick roller 13, and at a side opposite to the pick rubber portion 131, flexible, radial members 132 are disposed in positions, and arcuate portions 1331 and 1332 to be contacted with the accumulated bills P are disposed adjacently to the pick rubber portions 131, the arcuate portions being formed of a metal or resin (for example, POM) that is sufficiently lowly frictional compared with the pick rubber portion 131.

As shown in FIG. 2, on the feed rollerhaft 119, two feed roller 11 are disposed, and stopper roller 19 having the same diameter as that of the feed roller 11 are disposed in both outer sides with respect to the feed roller 11. Each of the stopper roller 19 has a highly frictional portion (for example, rubber member) 191 at a position to be in the same phase as that of each of the feed rubber portions 111 of the feed roller 11 in a rotational direction, and other peripheral portions are made of a metal (for example, aluminum) being sufficiently frictional compared with the feed rubber portions 111, pick rubber portions 131, and flexible, radial members 132.

A single flexible, radial member 112 is disposed on a central portion of the feed rollerhaft 119. Furthermore, the gate roller 12 are disposed at positions opposed to the stopper roller 19, the gate roller being for preventing running-out of a bill other than a bill to be run out by the feed roller 11. Two pick roller 13 are disposed on the pick rollerhaft 139, and furthermore disposed in the same or inside positions in an axial direction with respect to the stopper roller 19.

The radial member 112 disposed on the feed rollerhaft 119 is large in diameter compared with the feed roller, and furthermore the radial members 132 disposed on the pick roller 13 are made to have a diameter that allows pressure holding of a smallest bill by the radial members 132 even if the smallest bill is accumulated in any position in a bill accumulation section 110. Thus, even if the smallest bill is accumulated in any position in the bill accumulation section 110, the bill can be pre-passed to a running-out section. Moreover, a stopper 171 for limiting lower limit positions at a bill side of the pick roller 13 is disposed at a position where the stopper butts against the movable component 17 to prevent the accumulated bills P from being applied with pressure in a rotational phase other than a phase of the pick rubber portions 13.

Thus, passing force of each of the radial members 112 and 132 can be appropriately applied to a bill, and pre-passing of a bill, and correction of angled right and left portions of a front edge of a bill can be easily performed. Moreover, portions other than the feed rubber portions 111 and the pick rubber portions 131, which correspond to bill running-out phases of the feed roller 11 and the pick roller 13 respectively, are made to have a lowly frictional structure to prevent running-out of a bill by pre-passing force of the radial members 112 and 132. Moreover, the radial member 112 disposed in a central portion of the feed rollerhaft 119, or the radial members 132 disposed on the pick roller 13 has plural narrow and thin blades 1121 or 1321 including rubber material respectively, the blades being formed in an integral structure in a circumferentially radial direction. In addition, each of the radial members has a function of rotating while contacting to a top of the accumulated bills P and thus deflecting, so that it passes a top bill of the accumulated bills P in terms of frictional force generated between a surface of each of the blades 1121 or 1321 and the accumulated bills P. The feed rollerhaft 119 and the pick rollerhaft 139 are connected by a timing belt or gear (not shown) to each other, so that they can be rotated synchronously with each other by a drive motor (not shown), and relative speed of such rotation is adjusted by a timing pulley or gear.

While description was made in the embodiment on an example that two feed roller 11, two pick roller 13, and two stopper roller 19 were disposed respectively, and furthermore a flexible, radial member 112 disposed on the feed rollerhaft was disposed, the number of each of components to be disposed can be modified depending on a type or size of a paper sheet to be handled. Thus, the running-out mechanism of the embodiment can be widely used.

Next, operation of the bill running-out mechanism is described with reference to FIGS. 4 to 7.

FIGS. 4 to 7 show operation of running out bills from plural paper sheets of the accumulated bills P by the bill running-out mechanism.

Figure 4:
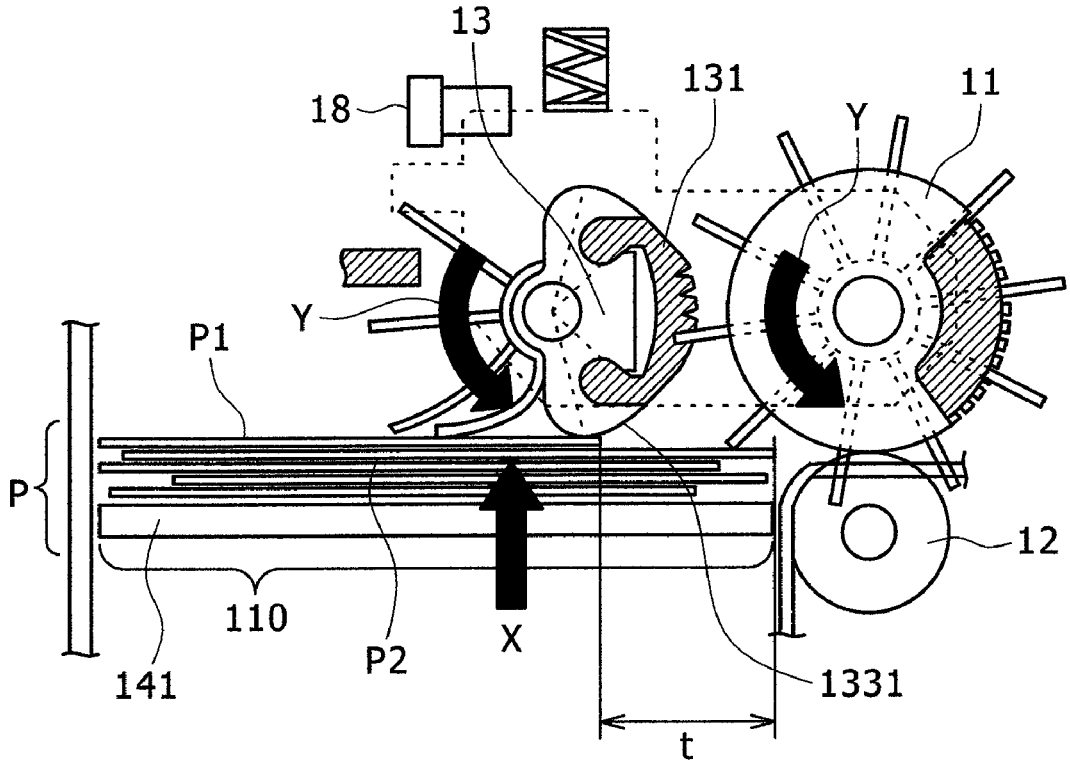
FIG. 4 is a diagram for explaining operation of the paper sheet running-out mechanism of the embodiment.

FIG. 4 shows an initial state where the plural paper sheets of the accumulated bills P are set in the bill accumulation section 110. Ends of the plural paper sheets of the accumulated bills P are not aligned, and a front edge of a bill accumulated in a top (hereinafter, simply called top bill) P1 and a front edge of a second top bill P2 are displaced by t from each other. The press plate 14 is raised in a direction of an arrow X from this state to press the pick roller 13 to the accumulated bills P, and a press plate position 141 as an appropriate press position is determined based on a signal from the press detection sensor 18. At that time, a phase of each of the pick roller 13 is set such that the arcuate portions 1331 are in an accumulated bill side. When the feed roller 11 and the pick roller 13 are rotated in a direction of an arrow Y in this state, running-out of bills is started.

Figure 5:
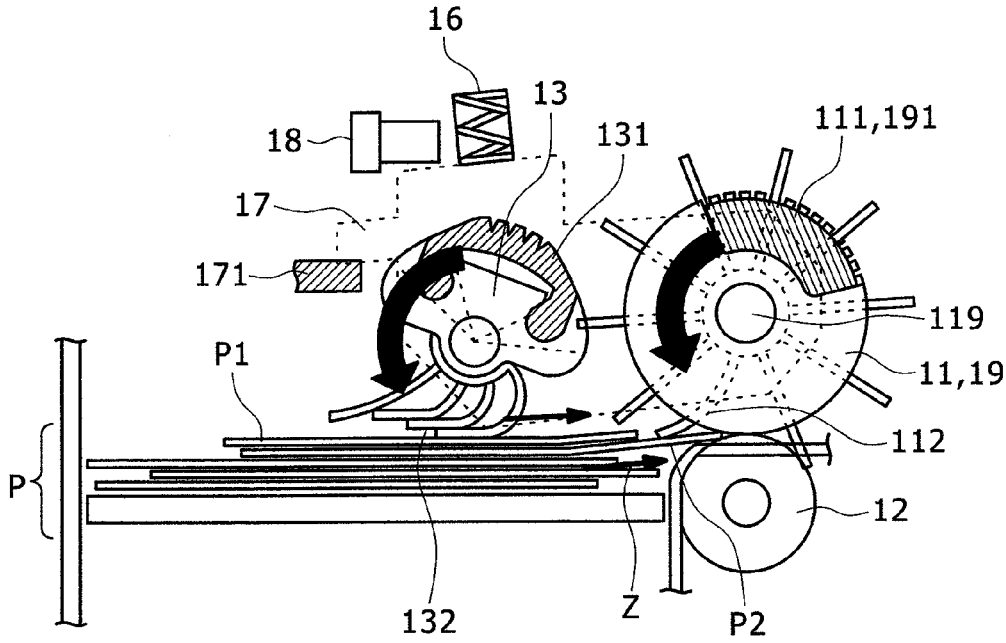
FIG. 5 is a diagram for explaining operation of the paper sheet running-out mechanism of the embodiment.

When running-out of bills is started, as shown in FIG. 5, on the pick roller 13 being pressed to the accumulated bill side by the movable component 17 and the spring 16, the movable component 17 butts against the stopper 171 for limiting the lower limit positions at the bill side of the pick roller 13 such that the accumulated bills P are not applied with pressure. In this state, the top bill P1 is pre-passed to a running-out section side (direction of an arrow Z) by the radial members 132 disposed on the pick roller 13. At that time, the radial member 112 disposed on the central portion of the feed rollerhaft 119 first tries to pass the second top bill P2 to the bill running-out section. However, the radial members 112 and 132 give a weak pre-passing force by which a bill is not run out in the lowly frictional portions other than the feed rubber portions 111, pick rubber portions 131, and highly frictional portions 191 respectively. Therefore, the second top bill P2 is retained while butting against lowly frictional portions other than portions in the running-out phase of the stopper roller 19 and portions of the gate roller 12 disposed at positions opposed to the lowly frictional portions.

Then, the top bill P1 is moved in the running-out direction Z by the radial members 132 disposed on the pick roller 13 and the radial member 112 disposed on the central portion of the feed rollerhaft 119, and butts against the stopper roller 19. Furthermore, the top bill P1 that has butted against the stopper roller 19 is applied with force in a drawing direction into the bill running-out section by the radial member 112 disposed on the feed rollerhaft 119, so that the top bill P1 is drawn into the stopper rolleride without buckling, and aligned in angled right and left portions of a front edge of a paper sheet.

Figure 6:
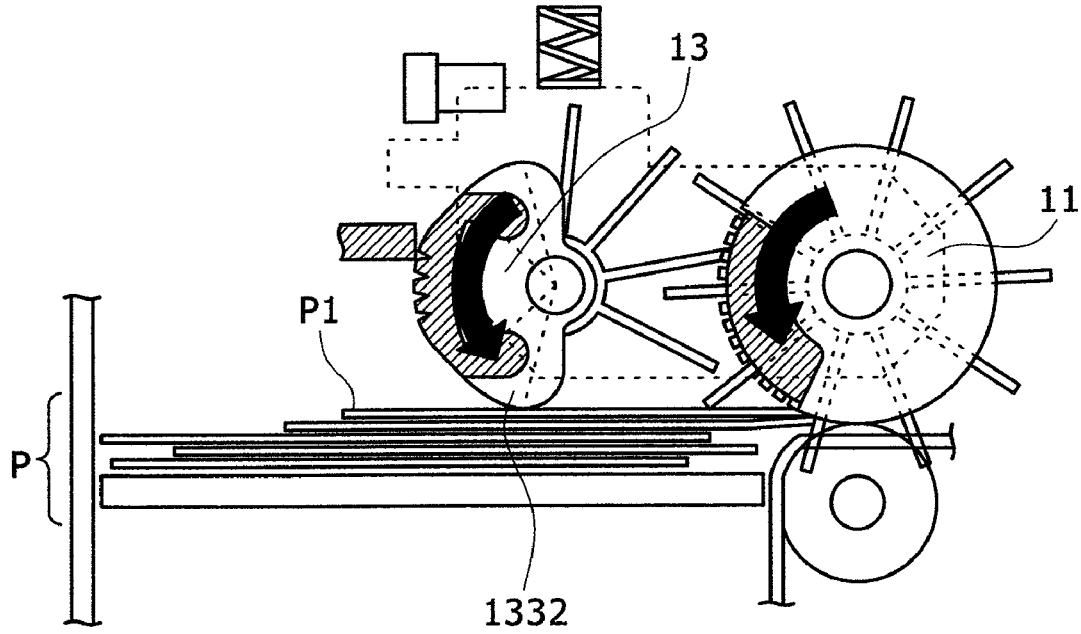
FIG. 6 is a diagram for explaining operation of the paper sheet running-out mechanism of the embodiment.
Figure 7:
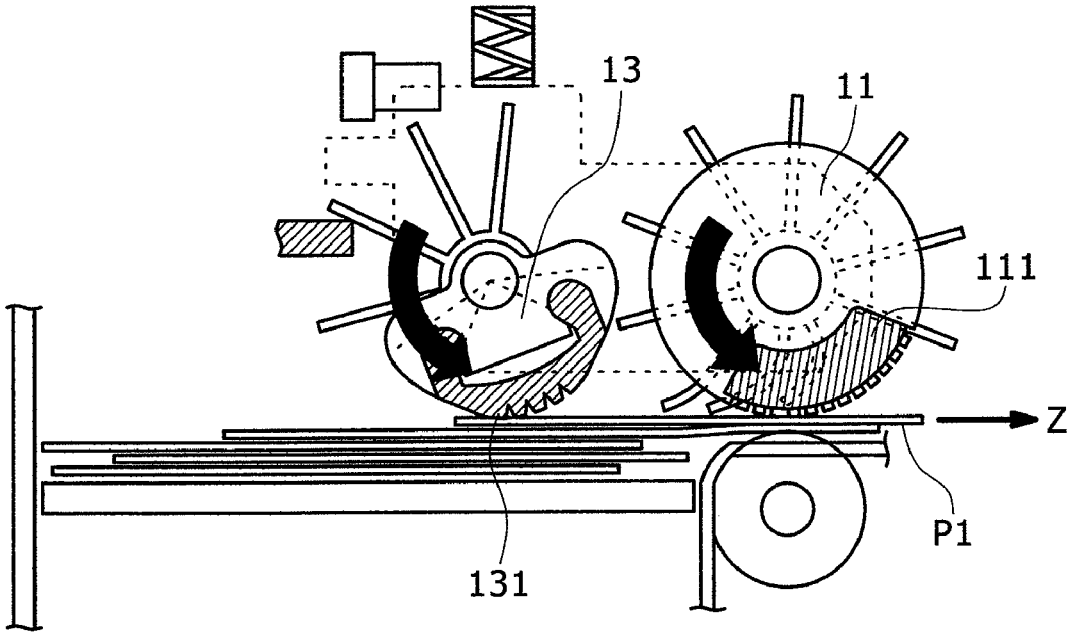
FIG. 7 is a diagram for explaining operation of the paper sheet running-out mechanism of the embodiment.

Then, as shown in FIG. 6, the arcuate portions 1332 of the pick roller 13 contact to the accumulated bills P and press it. Then, as shown in FIG. 7, only the top bill P1 is passed into the running-out section and run out by the feed rubber portions 111 of the feed roller 11 and the pick rubber portions 131 of the pick roller 13. Then, the run-out top bill P1 is carried to a downstream side by a not-shown roller. According to the above operation, bills that were accumulated in an unaligned condition can be run out one by one with inclination being corrected.

The bill running-out mechanism is used in, for example, an ATM set on an outer wall. Thus, in a presenter method in which a bill is horizontally put in and out into/from a thin slot-like port suitable for the bill, even if foreign bills being different in bill size in the running-out direction are randomly accumulated, the bills can be run out one by one from a top bill of accumulated bills without buckling or damaging the bills. The invention is not limitedly applied to the bill handling mechanism of the ATM, and can be applied to a paper running-out mechanism of equipment for handling papers for a copier, printer or the like.

What is claimed is:

1. A paper sheet running-out mechanism for accumulated paper sheets, comprising:

a feed roller for running out the paper sheets one by one by rotation, the feed roller including a peripheral portion having a higher friction than a friction of another peripheral portion of the feed roller;

a gate roller disposed facing the feed roller, to prevent running-out of a paper sheet other than a paper sheet to be contacted with the feed roller and thus run out;

a pick roller, for passing the paper sheets to a portion between the feed roller and the gate roller while in contact with the paper sheets being accumulated, the pick roller including a peripheral portion having a higher friction than a friction of another peripheral portion of the pick roller; and a plate member for supporting the paper sheets being accumulated, and pressing the paper sheets to the pick roller;

wherein the pick roller includes at least one flexible radial member extending therefrom; and wherein the higher friction peripheral portion of the pick roller and the at least one flexible radial member are disposed at opposite positions along a circumference of the pick roller.

2. The paper sheet running-out mechanism according to claim 1, wherein arcuate portions of the pick roller, having a lower friction compared with the higher friction peripheral portion of the pick roller, are disposed between the higher friction peripheral portions of the pick roller and the at least one flexible radial member, so that the arcuate portions contact the paper sheets.

3. The paper sheet running-out mechanism according to claim 2, wherein arcuate portions comprise curved portions of a non-circular pick roller.

4. The paper sheet running-out mechanism according to claim 1, wherein a stopper member for preventing running-out of the paper sheet passed by the at least one flexible radial member, is disposed on an outer side of the feed roller in an axial direction of the feed roller.

5. The paper sheet running-out mechanism according to claim 4:

wherein the stopper member is made as stopper roller that is coaxial with the feed roller, and situated on an outer side of the feed roller, the stopper roller including a peripheral portion having a higher friction than a friction of another peripheral portion of the stopper roller;

wherein the stopper roller is disposed where the higher friction portion of the stopper roller and the higher friction portion of the feed roller are in the same phase in a rotational direction respectively; and wherein the gate roller is disposed opposite to the stopper roller respectively.

6. The paper sheet running-out mechanism according to claim 5, wherein the pick roller is disposed in the same or inside positions with respect to the stopper roller in an axial direction perpendicular to a running-out direction.

7. The paper sheet running-out mechanism according to claim 4, wherein a flexible radial member is mounted on a feed roller shaft of the feed roller, and is disposed on an inner side of the feed roller with respect to the stopper roller in an axial direction perpendicular to a running-out direction.

8. The paper sheet running-out mechanism according to claim 1, further comprising at least one of a feed roller shaft and a pick roller shaft;

wherein the feed roller shaft includes a plurality of stopper rollers, a plurality of feed rollers, and at least one flexible radial member disposed thereon; and wherein the pick roller shaft includes a plurality of pick rollers and the at least one flexible radial member disposed thereon.

9. The paper sheet running-out mechanism according to claim 1, wherein a higher friction periphery portion of at least one of the feed roller and the pick roller comprises rubber.

10. The paper sheet running-out mechanism according to claim 9, wherein a lower friction periphery portion of at least one of the feed roller and the pick roller comprises at least one of a metal and a resin.

11. The paper sheet running-out mechanism according to claim 10, wherein a lower friction periphery portion of at least one of the feed roller and the pick roller comprises aluminum.

* * * * *